US007347339B2

(12) United States Patent
Bangi et al.

(10) Patent No.: US 7,347,339 B2
(45) Date of Patent: Mar. 25, 2008

(54) HOT-FILL BOTTLE HAVING FLEXIBLE PORTIONS

(75) Inventors: Monis Bangi, Woodridge, IL (US); Michael R. Mooney, Frankfort, IL (US)

(73) Assignee: Constar International, Inc., Philadelphia, PA (US)

( * ) Notice: Subject to any disclaimer, the term of this patent is extended or adjusted under 35 U.S.C. 154(b) by 0 days.

(21) Appl. No.: 11/091,564

(22) Filed: Mar. 28, 2005

(65) Prior Publication Data

US 2005/0218108 A1 Oct. 6, 2005

Related U.S. Application Data

(60) Provisional application No. 60/558,790, filed on Apr. 1, 2004.

(51) Int. Cl.
*B65D 1/02* (2006.01)
*B65D 1/46* (2006.01)
*B65D 23/00* (2006.01)

(52) U.S. Cl. ..... 215/381; 215/382; 220/666; 220/669; 220/671; 220/675

(58) Field of Classification Search ..... 215/381, 215/900, 382–384, 379; 220/666, 609, 669, 220/671, 675
See application file for complete search history.

(56) References Cited

U.S. PATENT DOCUMENTS

| | | | | |
|---|---|---|---|---|
| 2,022,520 | A | 11/1935 | Philbrick | 215/1 |
| D100,231 | S | 6/1936 | Steuernagle | |
| D163,426 | S | 5/1951 | Smurr | |
| 3,225,950 | A | 12/1965 | Josephsen et al. | 215/1 |
| D288,294 | S | 2/1987 | Taylor et al. | D9/408 |
| 4,863,046 | A | 9/1989 | Collette et al. | 215/1 |
| 5,054,632 | A | 10/1991 | Alberghini et al. | 215/1 |
| 5,092,475 | A | 3/1992 | Krishnakumar et al. | 215/1 |
| 5,141,120 | A | 8/1992 | Brown et al. | 215/1 |
| 5,141,121 | A | 8/1992 | Brown et al. | 215/100 |
| 5,178,289 | A | 1/1993 | Krishnakumar et al. | 215/1 |
| 5,199,588 | A | 4/1993 | Hayashi | 215/1 |
| 5,381,910 | A | 1/1995 | Sugiura et al. | 215/1 |
| 5,472,105 | A * | 12/1995 | Krishnakumar et al. | 215/384 |
| 5,735,420 | A | 4/1998 | Nakamaki et al. | 215/373 |
| 5,758,790 | A | 6/1998 | Ewing, Jr. | 215/384 |
| D397,297 | S | 8/1998 | Yang | D9/523 |
| 5,971,184 | A | 10/1999 | Krishnakumar et al. | 215/384 |
| D441,658 | S | 5/2001 | Lichtman et al. | D9/538 |
| 6,223,920 | B1 | 5/2001 | Lane et al. | 215/384 |
| 6,264,053 | B1 * | 7/2001 | Slat | 215/384 |
| D482,287 | S | 11/2003 | Kraft | D9/540 |
| 6,763,969 | B1 * | 7/2004 | Melrose et al. | 220/669 |
| 6,981,604 | B2 * | 1/2006 | Iizuka et al. | 215/381 |
| 7,080,747 | B2 * | 7/2006 | Lane et al. | 215/381 |
| 2002/0158038 | A1 * | 10/2002 | Heisel et al. | 215/382 |
| 2005/0098566 | A1 * | 5/2005 | Bezek | 220/669 |
| 2005/0139572 | A1 * | 6/2005 | Pedmo et al. | 215/381 |

FOREIGN PATENT DOCUMENTS

| | | |
|---|---|---|
| WO | WO 00/68095 | 11/2000 |

* cited by examiner

*Primary Examiner*—Sue A. Weaver
(74) *Attorney, Agent, or Firm*—Woodcock Washburn LLP

(57) ABSTRACT

A flexible hot fill container includes a body having a label portion and a flex portion. The flex portion includes flex panels and support structure fields. Both the support structure fields and flex panels deform inwardly upon vacuum conditions. Recess sidewalls in the flex panels provide support.

25 Claims, 10 Drawing Sheets
(2 of 10 Drawing Sheet(s) Filed in Color)

HOT-FILL BOTTLE HAVING FLEXIBLE PORTIONS

CROSS REFERENCE TO RELATED APPLICATIONS

This application claims the benefit of U.S. Provisional Application No. 60/558,790, which was filed on Apr. 1, 2004 and is incorporated herein by reference.

FIELD OF THE INVENTION

This invention relates to containers, and more particularly to hot fillable containers having flexible portions to absorb vacuum.

BACKGROUND OF THE INVENTION

Perishable beverage and food products are often placed into containers at elevated temperatures. In a conventional hot-fill process, the liquid or flowable product is charged into a container at elevated temperatures, such as 180 to 190 degrees F., under approximately atmospheric pressure. Because a cap hermetically seals the product within the container while the product is at the hot-filling temperature, hot-fill plastic containers are subject to negative internal pressure (that is, relative to ambient pressure) upon cooling and contraction of the products and any entrapped air in the head-space.

It has been a goal of conventional hot-fill container design to form stiff cylindrical portions (in transverse cross section) that maintain a cylindrical shape upon cooling. Thus, conventional hot-fill containers include designated flexing portions—vacuum panels—that deform when subject to typical hot-fill negative internal pressures. The inward deflection of the vacuum panels tends to equalize the pressure differential between the interior and exterior of the container—that is, absorb vacuum—so as to enhance the ability of the cylindrical sections to maintain an attractive shape, to enhance the ease of labeling, or like commercial appeal. Some container designs are symmetric about a longitudinal centerline and designed with stiffeners to maintain the intended cylindrical shape while the vacuum panels deflect. For example, U.S. Pat. Nos. 5,178,289, 5,092,475, and 5,054,632 teach stiffening portions or ribs to increase hoop stiffness and eliminate bulges while integral vacuum panels collapse inwardly. U.S. Pat. No. 4,863,046 is designed to provide volumetric shrinkage of less than one percent in hot-fill applications.

Other containers include a pair of vacuum panels, each of which has an indentation or grip portion enabling the container to be gripped between a user's thumb and fingers. For example, U.S. Pat. No. 5,141,120 teaches a bottle having a hinge continuously surrounding a vacuum panel, which includes indentations for gripping. In response to cooling of the container contents, the hinge enables the entire vacuum panel to collapse inwardly. U.S. Pat. No. 5,141,121 similarly teaches a bottle having an outward bulge that inverts in response to cooling of the container contents. Each of the patents referred to herein by patent number is incorporated by reference in its entirety.

It has been observed that for some containers undergoing vacuum conditions, inward deflection of portions of the container, such as panels, causes regions circumferentially spaced apart from the panels to deflect outwardly. For example, some containers having opposing handgrips, which may tend to deflect inwardly upon vacuum conditions, have label panels that may deflect outwardly under vacuum conditions.

Also, some containers are subject to creasing. For example, edges of a flex panel may locally bulge outwardly after hot-filling, which is unattractive.

SUMMARY OF THE INVENTION

In accordance with one preferred embodiment of the present invention, there has now been provided a hot-fillable container including a neck portion, an enclosed bottom portion and a body portion disposed between the neck portion and the bottom portion. The body portion has flex panels disposed about the circumference of the body portion. The flex panels include a recessed central panel and a rim extending along a periphery of the central panel. The central panels are capable of inward deflection in response to the hot-filling process. A support structure fields is interposed between adjacent flex panels, and is also capable of inward deflection in response to the hot-filling process. The support structure field includes non-vertical ribs that abut one another along at least a portion of their length. At least some of the non-vertical ribs includes opposing ends that terminate at the rim of an adjacent flex panel.

In accordance with another preferred embodiment provided by the present invention, there has now been provided a hot-fillable container including a neck portion, an enclosed bottom portion and a body portion disposed between the neck portion and the bottom portion. The body portion includes a flex portion that has a plurality of spaced apart flex panels circumferentially disposed about the body portion and a support structure field interposed between adjacent flex panels. The support structure field includes a series of non-vertical ribs that abut one another along at least a substantial portion of their lengths so as to define non-vertical hinges that are capable of facilitating radial deflection of the support structure field.

In accordance with yet another preferred embodiment of the present invention, there has now been provided a hot-fillable container including a neck portion, an enclosed bottom portion and a body portion disposed between the neck portion and the bottom portion. The body portion includes a flex portion that has a plurality of spaced apart flex panels and ribbed regions. The maximum magnitude of radially inward deflection of a central panel of each of the flex panels is substantially equivalent to the maximum magnitude of raidally inward deflection of each of the ribbed regions in response to a pressure differential of about 5 psi between an exterior and interior of the container.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF ILLUSTRATIVE EMBODIMENTS

Figure 1:
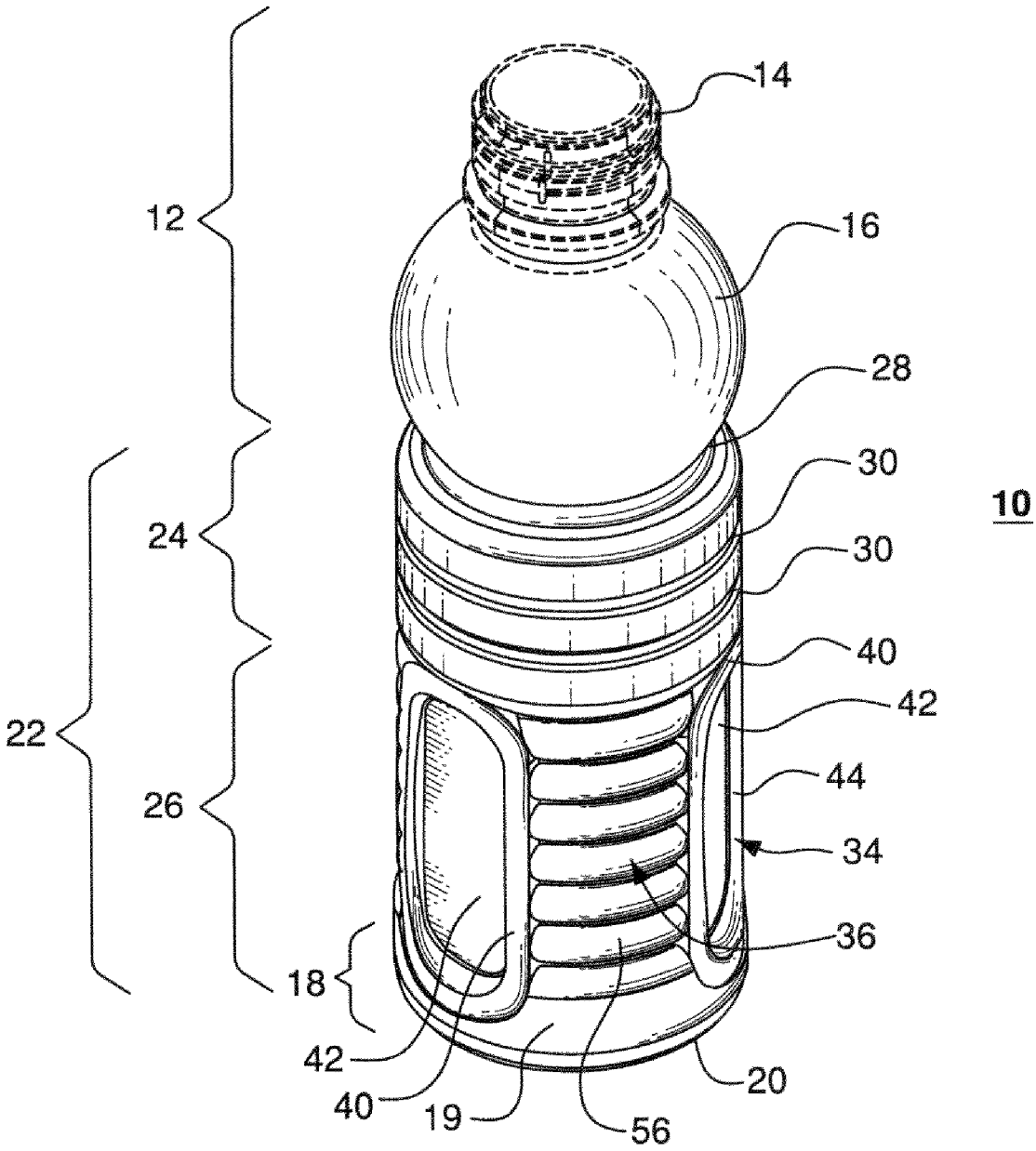
FIG. 1 is a perspective view of a container.
Figure 2:
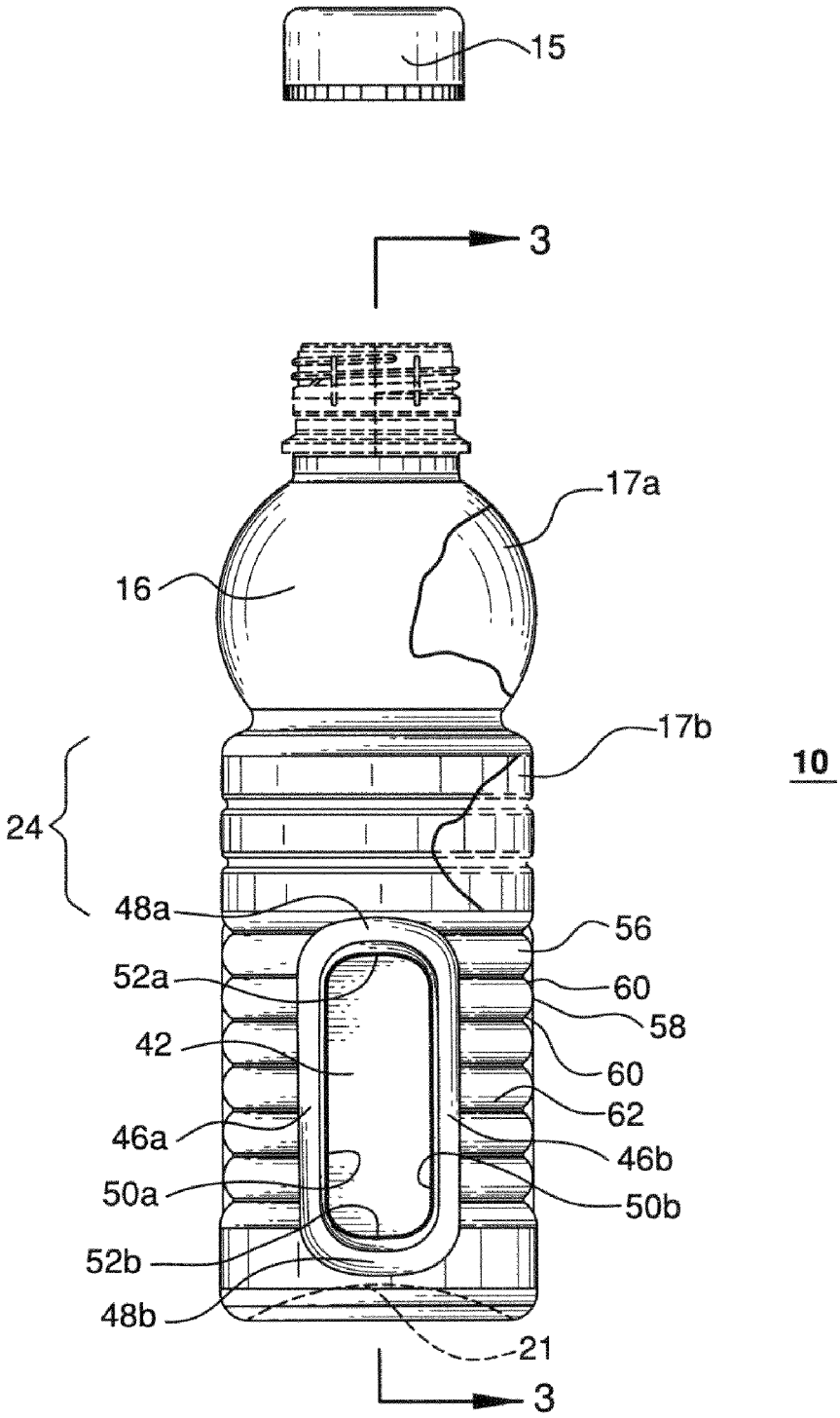
FIG. 2 is a side view of the container of FIG. 1.

A container 10 suitable for hot-filling includes a neck portion 12, a bottom portion 18, and a body portion 22. As best shown in FIGS. 1 and 2, neck portion 12 includes a finish 14 for receiving a closure (shown schematically in FIG. 2) and a dome 16. Preferably, container 10 is for holding a beverage, although container 10 and the principles disclosed herein may be employed for containers of any variety and for any product. Preferably, container 10 is formed of any plastic suitable for hot-filling, including, for example, polyethylene terephthalate (PET), polybutylene terephthalate (PBT), polyethylene naphthalate (PEN), or a blend comprising the same. A perform can be made by injection molding the plastic into an injection mold. The perform is then stretched and blown into a shaped blow mold to form a container. The present invention is not limited to the above-listed exemplary materials or processes.

Figure 3:
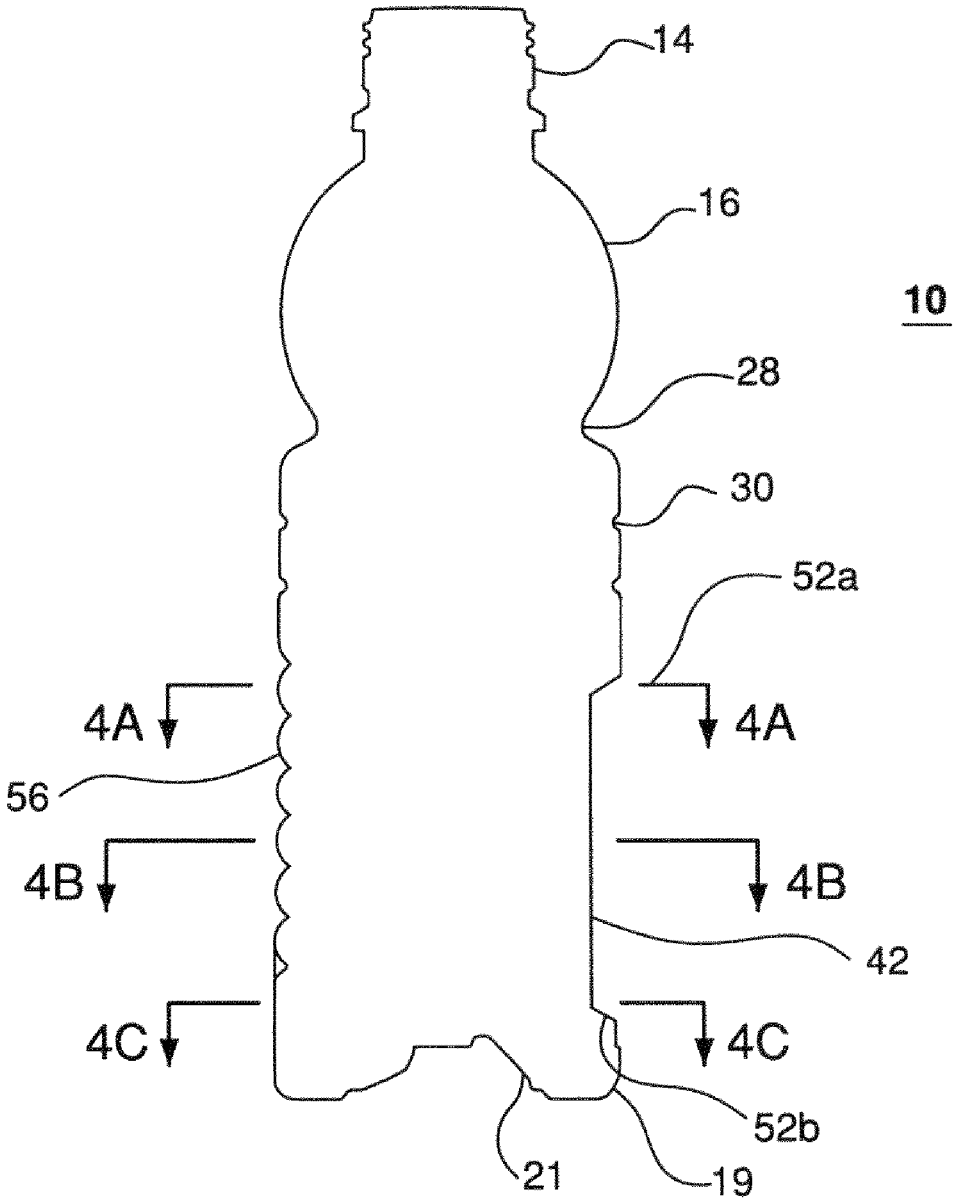
FIG. 3 is a longitudinal cross sectional view of the container of FIG. 2 taken through line 3-3.

Bottom portion 18 includes a heel 19 that extends downwardly from body portion 22 to a standing ring 20. A base 21, as shown in FIG. 3, is a reentrant portion that extends inwardly and upwardly from standing ring 20. The present invention encompasses employing any type or configuration of finish 14, dome 16, heel 19, standing ring 20, and base 21. Preferably, dome 16 is suitable for receiving a label, such as a shrink-wrapped label 17*a* shown schematically in FIG. 2.

Body portion 22 preferably includes a label portion 24 and a separate flex portion 26. Body portion 22 is essentially separated from dome 16 by a deep, circumferential groove 28 that provides hoop strength to the surrounding region. A label 17*b*, as partially schematically indicated in FIG. 2, preferably wraps around the circumference of label portion 24.

Label portion 24 preferably has a round cross section that is interrupted only by circumferential ribs 30 that provide hoop strength to the label portion 24. Circumferential ribs 30 are not required to be as deep as groove 28, although the present invention is not limited to any particular relationship between groove 28 and ribs 30, or even to existence of such groove and ribs. Label 17*b* preferably, for aesthetic reasons, covers circumferential ribs 30.

Flex portion 26 preferably is disposed below label portion 24 to facilitate ease of labeling and gripping. Preferably, flex portion 26 is not covered with a label. Flex portion 26 includes plural flex panels 34 and support structure fields 36. Preferably, container 10 has at least three flex panels (as shown in the figures) although the present invention encompasses employing any number of flex panels according the particular parameters of the application (such as bottle diameter, wall thickness, hot-filling conditions, desired vacuum absorption, and the like).

Each flex panel 34 includes a rim 40, a central panel 42, and a recess sidewall 44. Rim 40 preferably comprises a pair of opposing lateral rims 46*a* and 46*b*, a top rim 48*a*, and a bottom rim 48*b*. Preferably, rim components 46*a*, 46*b*, 48*a*, and 48*b* are continuous, and formed by a thin, uniform strip or border.

Recess sidewall 44 preferably comprises a pair of opposing lateral recess walls 50*a* and 50*b* that extend from opposing edges of central panel 42 to lateral rims 46*a* and 46*b*, respectively. Similarly, a top recess wall 52*a* and a bottom recess wall 52*b* extend between top and bottom edges of central panel 42 to top rim 48*a* and bottom rim 48*b*, respectively.

Central panel 42 preferably is substantially flat in its as-molded state, and has rounded corners. Accordingly, rim 40 and recess sidewall 44 have rounded corners to essentially match the outline of central panel 42. Preferably, the plane of central panel 42 is parallel to the longitudinal axis of container 10. Such orientation, while not essential, enables lateral recess walls 50*a* and 50*b* to be approximately uniform in radial dimension, which may enhance the reinforcing function of recess sidewall 44.

Support structure field 36 preferably spans between rims 40 of adjacent flex panels 34, and includes non-vertical supports, such as flex area ribs 56. As shown in the figures, ribs 56 may be formed by multiple concave (as viewed from inside container 10) outer portions 58, each of which has an upper and lower inwardly directed end 60. An end 60 of one rib 56 joins an end 60 of an adjacent rib 56 at a ridge 62.

Preferably, at least some of the circumferential ends of flex area ribs 56 are disposed proximate to or in contact with lateral rims 46*a*, 46*b* of flex panel 34. Such configuration may support lateral rims 46*a*, 46*b* and may prevent deformation of rims 46*a*, 46*b* under vacuum conditions, and may also inhibit creasing. Such configuration is not essential—rather, the present invention encompasses any configuration set forth in the claims.

Figure 5B:
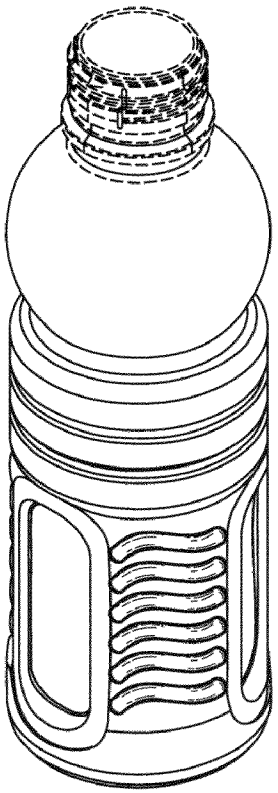
FIG. 5B is a schematic view of an alternative embodiment of a portion of the container of FIG. 1.
Figure 5A:
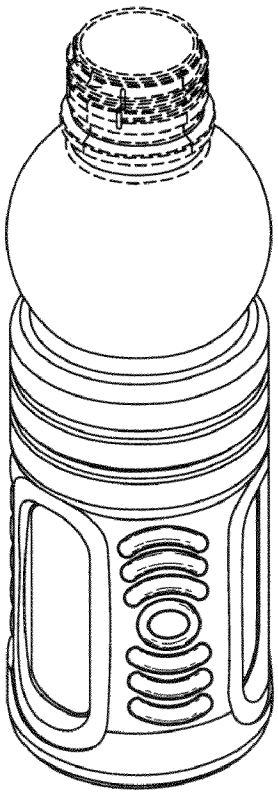
FIG. 5A is a schematic view of an alternative embodiment of a portion of the container of FIG. 1.
Figure 5D:
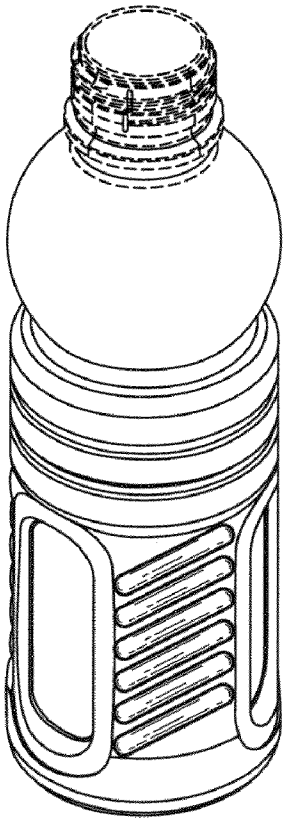
FIG. 5D is a schematic view of an alternative embodiment of a portion of the container of FIG. 1.
Figure 5C:
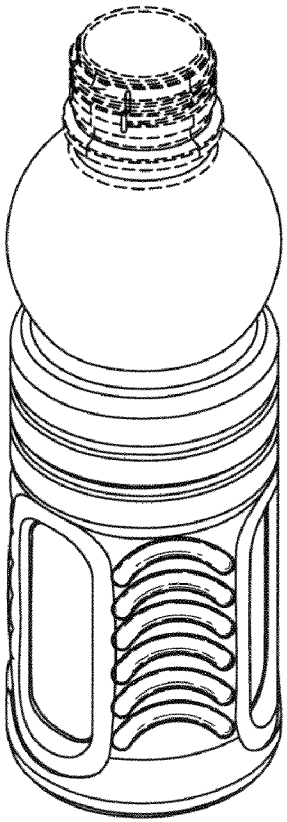
FIG. 5C is a schematic view of an alternative embodiment of a portion of the container of FIG. 1.

Flex ribs 56 are illustrated in the figures as a series of concave portions 58. The invention is not limited to such configuration of ribs, but rather encompasses any non-vertical structure, such as ribs that are oriented other than horizontally. For example, FIGS. 5A, 5B, 5C, and 5D illustrate alternative embodiments of a pattern of supports within support structure field 36. Such structure is designated as support structures 37*a*, 37*b*, 37*c*, and 37*d*, respectively. FIG. 5A schematically shows support structure 37*a*: a central circle or island with arcuate ribs disposed above and below. FIG. 5B schematically shows support structure 37*b*: undulating ribs. FIG. 5C schematically shows support structure 37*c*: arcuate ribs, which may be oriented to open downwardly. Alternatively, the arcuate ribs may open upwardly (not shown in the Figures). FIG. 5D schematically shows support structure 37*d*: obliquely oriented ribs that are substantially straight or rectilinear in elevational view (although the oblique ribs will, of course, curve with the circumference of the container).

The flex ribs shown in the figures are not vertical, or, where the ribs are not rectilinear, the longitudinal center line or best fit line through the planar projection of the rib is not vertical. The interface between the ribs 56, such as ridge 62 and the region where ridge 62 merges into an adjacent rib end 60, defines non-vertical hinges. The non-vertical structure of the ribs and spaces between ribs enhance the ability of the support structure field to bend relative to a horizontal axis even while such ribs will enhance hoop stiffness of the support structure field 36, 37*a*, 37*b*, 37*c*, or 37*d*. In this regard, the ribs of support structure field 36, 37*a*, 37*b*, 37*c*, or 37*d* stiffen such support structure field from flexing in a horizontal plane or about a vertical axis.

Figure 4A:
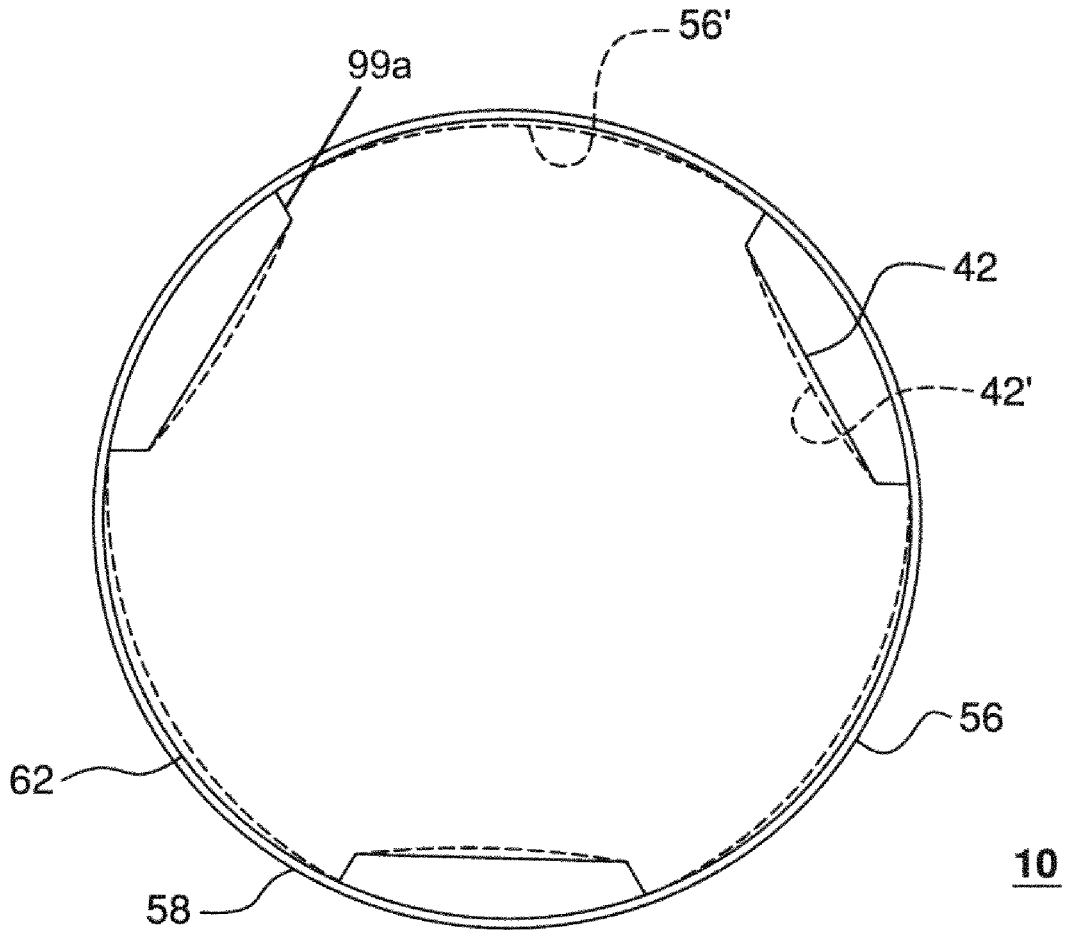
FIG. 4A is a cross sectional view normal to the longitudinal cross sectional view taken through line 4A-4A.
Figure 4B:
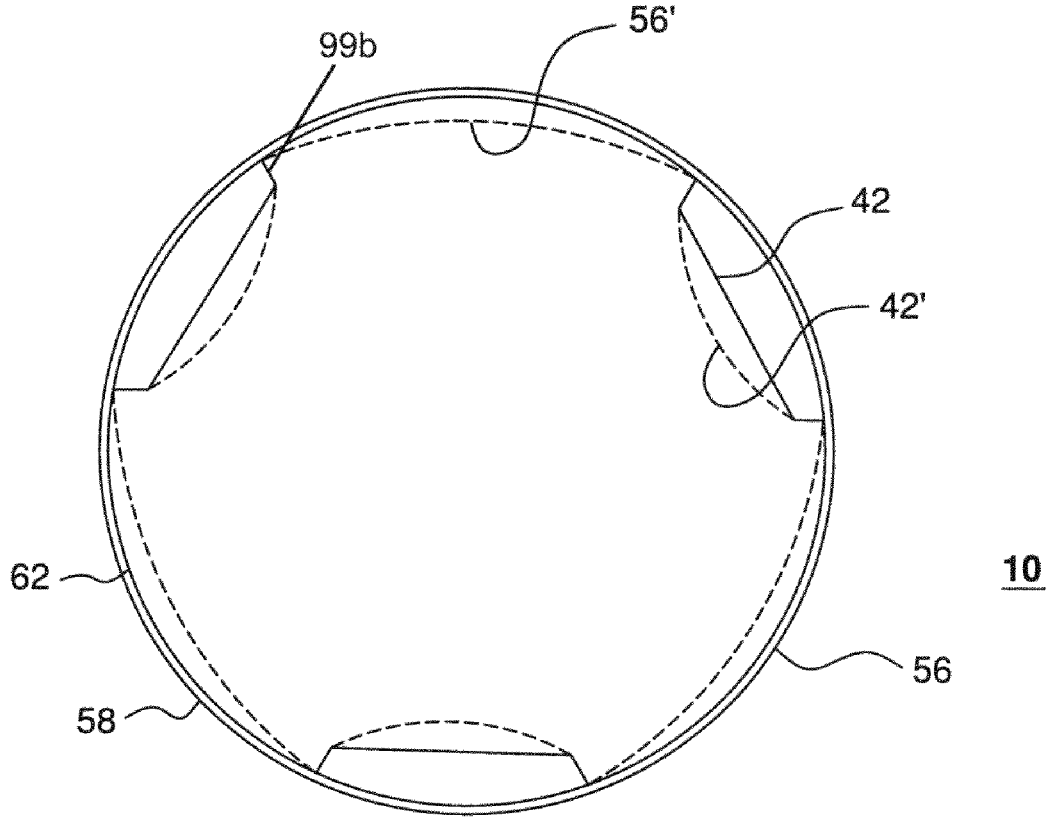
FIG. 4B is a cross sectional view normal to the longitudinal cross sectional view taken through line 4B-4B.
Figure 4C:
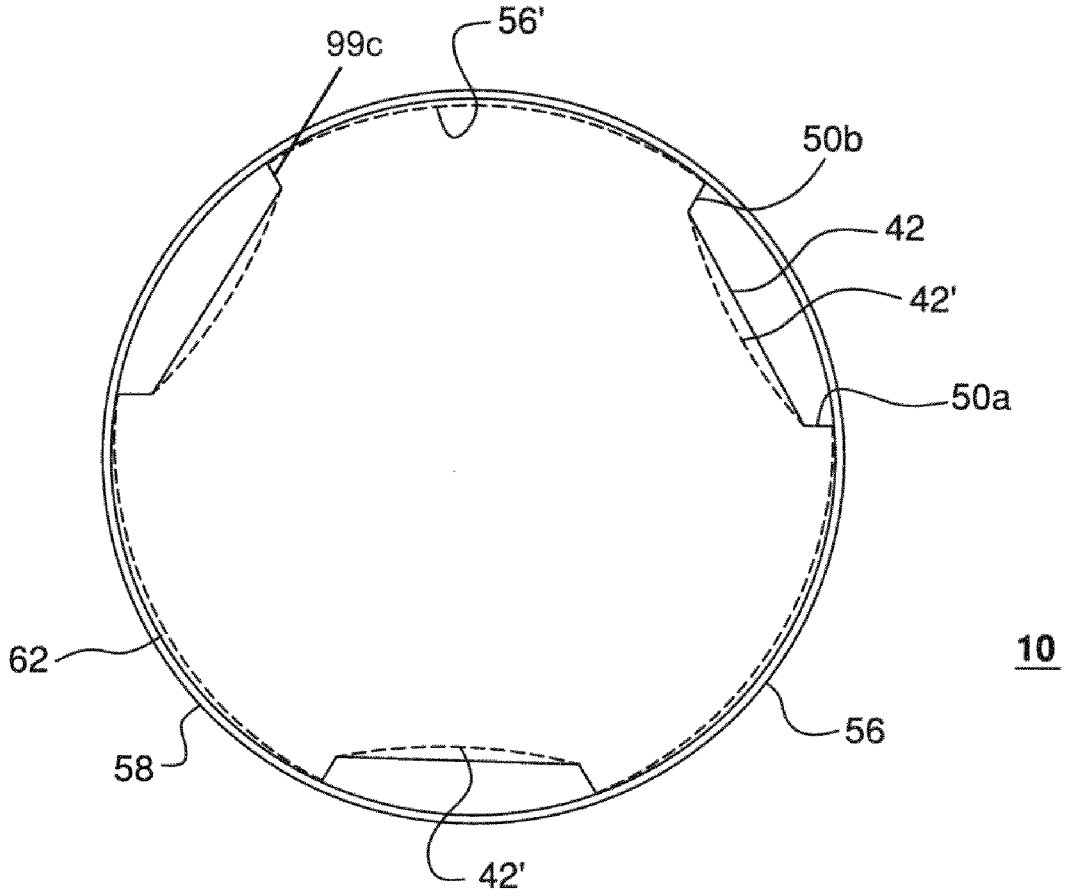
FIG. 4C is a cross sectional view normal to the longitudinal cross sectional view taken through line 4C-4C.

FIGS. 4A, 4B, and 4C illustrate aspects of the function of the preferred container 10. The solid lines illustrate the cross sections in the as-molded state, and the dashed lines schematically indicate the cross sections on container 10 under conventional vacuum conditions created by filling the product (not shown) at approximately 185 degrees F. and then capping container 10 and allowing it to cool to room temperature. In FIGS. 4A, 4B, and 4C, a solid double line in the region of the flex area ribs 56 shows both concave outer portion 58 and ridge 62 as solid lines, and omits the cross sectional cross-hatching for clarity. For clarity, deformation is indicated by a single dashed line 56' is this region. Dashed line 42' indicates deformation of central panel 42 of flex panel 34.

Central panels 42 of the flex panels 34 deform inwardly, as expected. As best shown in FIG. 4B, the centers of the regions between the flex panels (that is, in support structure field 36) also deflect inward to absorb vacuum. FIG. 4A, which shows the cross section near an upper end of flex portion 26, shows a relatively small magnitude of inward deflection upon vacuum. Similarly, FIG. 4C, which shows the cross section near a lower end of flex portion 26, also shows a relatively small magnitude of inward deflection upon vacuum. Preferably, and in order to enhance the total magnitude of vacuum absorption, the magnitude of maximum inward deflection of central panel 42 is approximately the same as the magnitude of maximum inward deflection of support structure field 36. Such relative magnitudes are not essential, and the present invention encompasses any relative magnitudes of inward deflection (or even no inward deflection of the support structure fields), according to the language of the claims. It should be understood that the deflection shown by broken lines is for illustration purposes only. Actual deflection may vary in relative magnitude, geometry and/or uniformity.

Figure 6:
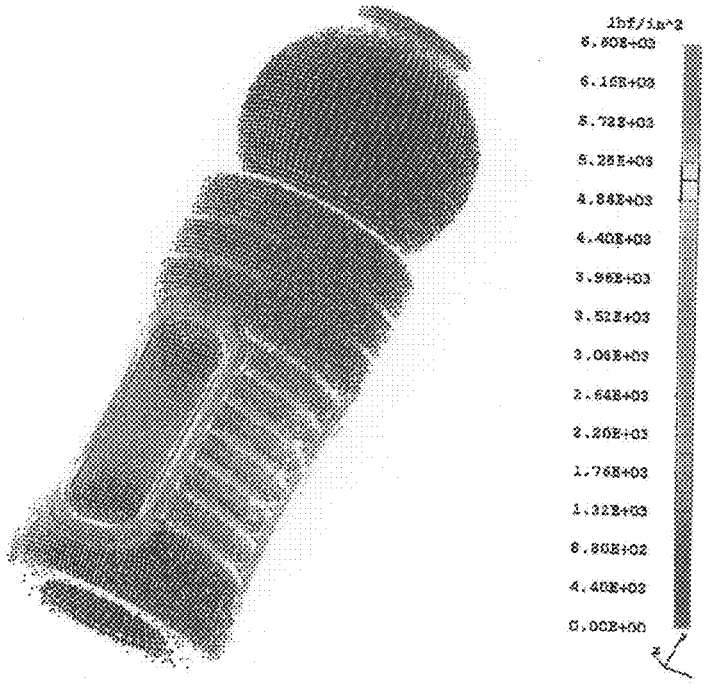
FIG. 6 is a (calculated) graphical depiction of the stresses formed in the container of FIG. 1 as a result of a conventional hot-filling process.
Figure 7:
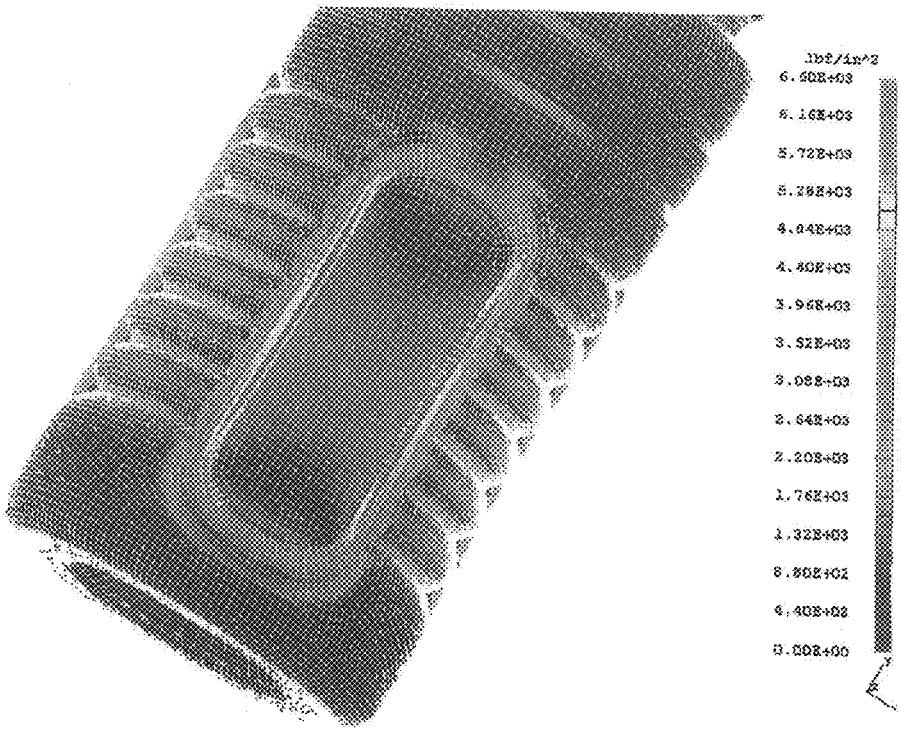
FIG. 7 is an enlarged view of the graphical depiction of FIG. 5.
Figure 8:
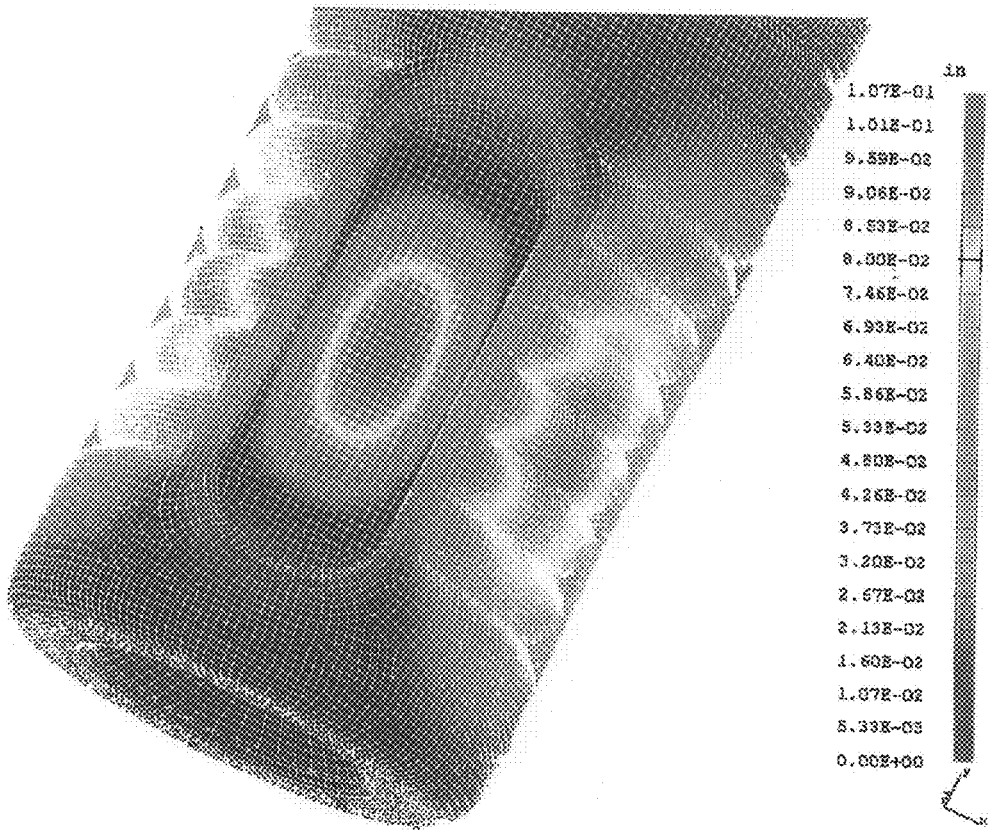
FIG. 8 is an enlarged (calculated) graphical depiction of the deformation formed in the container of FIG. 1 as a result of a conventional hot-filing process.

The functional aspects of container 10 are further illustrated in FIGS. 6, 7, and 8. FIGS. 6 and 7 graphically show calculated von Mises stress for container 10 based on a geometric non-linear analysis using 2-D shell elements. Von Mises stress at each point is an averaged stress value calculated by adding the squares of the 3 component stresses (X, Y and Z directions) and taking the square root of their sums. Container 10 was mathematically analyzed as a full bottle without the finish and restrained at the top surface.

Stresses were calculated based on a 5 psi vacuum. The temperature variation under vacuum performance was ignored. The wall thickness of container 10 was assumed to be 0.015 inches uniform throughout container 10, except the neck and base 21, which were presumed to be 0.050 inches thick. As best shown in FIG. 7, lateral recess sidewalls 50*a* and 50*b* undergo the greatest magnitude of von Mises stress under vacuum conditions, thereby (among other things) providing stiffening and inhibiting creasing of lateral rims 48*a* and 48*b*, respectively. Ridges 62 undergo higher stress than does concave outer portion 58 of flex area ribs 56.

FIG. 8 illustrates calculated deformation based on the same conditions as the calculated stresses of FIGS. 6 and 7. In general agreement with the stresses shown in FIG. 7, central panel 42 bows inwardly, with the greatest magnitude of deformation occurring in its center.

As best shown in FIG. 8, lateral recess sidewalls 50*a* and 50*b* and lateral rims 46*a* and 46*b* function as stiffeners relative to central panel 42. Also, top and bottom recess sidewalls 52*a* and 52*b* and top and bottom rims 48*a* and 48*b* act as stiffeners relative to central panel 42. As shown in FIGS. 4A-4C, lateral recess sidewalls 50*a*and 50*b* form a hinge portion 99*a*, 99*b*, and 99*c* of the flex panel 34.

Accordingly, because the support structure field 36 undergoes inward deflection in addition to the inward deflection of the center panel 42 of flex panel 34, vacuum absorption is enhanced. The label panel portion is stiffened by ribs 30, and generally retains its circular shape to enhance labeling and appearance.

The present invention is illustrated with respect to a preferred embodiment, and the present invention is not limited to the particular structure described in the preferred embodiment of container 10. For example, the present invention encompasses a container in which a label panel (such as label portion 24 of container body 22) undergoes some deformation under vacuum conditions, becomes out-of-round under vacuum conditions, and/or is not circular in its as-molded state—even though such structure or function is not shown in the figures.

Furthermore, it is not essential that the container have separate flex portions 26 and label portions 24. For example, the present invention encompasses the body portion 22 of container 10 or (other body configuration of other container covered by the appended claims) being covered by a label (such configuration not shown in the figures). The non-mechanical and subjectively attractive appearance of body portion 22 renders it suitable for use without a label, and the flex panels 34 disposed about the circumference of container 10 enhance gripping, but such advantages are optional.

It is understood that persons familiar with hot-fill container technology will recognize additional advantages and features that flow from the present disclosure, and the present invention encompasses such additional advantages and features such that the scope of the invention is limited only by the claims.

What is claimed:

1. A hot-fillable container formed by blow molding, said container comprising:

a neck portion;

an enclosed bottom portion; and a body portion disposed between the neck portion and the bottom portion, the body portion including:

flex panels disposed about the circumference of the body portion, each of which includes a recessed central panel and a rim extending along a periphery of the central panel, the central panels being capable of inward deflection in response to the hot-filling process; and a support structure field interposed between adjacent flex panels, the support structure field including a series of non-vertical ribs that abut one another along at least a portion of their lengths, at least some of the non-vertical ribs including opposing ends that terminate at the rim of an adjacent flex panel, wherein the support structure field is capable of inward deflection in response to the hot-filling process.

2. The container of claim 1, wherein the stiffness of the support fields is greater about its vertical axis than about its horizontal axis.

3. The container of claim 1, wherein each flex panel comprises opposing lateral recess walls extending between the central panel and the rim.

4. The container of claim 3, wherein a central panel hinge portion is formed in the recess walls.

5. The container of claim 1, wherein non-vertical hinges are defined at an interface between adjacent non-vertical ribs, the non-vertical hinges diminish stiffness of the support structure field about a vertical axis.

6. The container of claim 5, wherein the fibs are substantially horizontal such that the non-vertical hinges are horizontal.

7. The container of claim 1, wherein said flex panels are at least three flex panels disposed approximately equidistant about a circumference of the container.

8. The container of claim 1 wherein the body portion includes a circumferential label portion disposed generally above the flex panels and the support structure field.

9. The container of claim 1 wherein the maximum magnitude of inward deflection of each of the central panels is approximately the same as that of the support structure field under vacuum conditions.

10. The container of claim 1, wherein at least some of the non-vertical ribs are concave as viewed from inside the container.

11. A hot-fillable container formed by blow molding, the container comprising:

a) a neck portion;

b) an enclosed bottom portion; and c) a body portion disposed between the neck portion and the bottom portion, the body portion including a flex portion comprising:

i) a plurality of spaced apart flex panels circumferentially disposed about the body portion, each of the plurality of flex panels including a central panel and a rim located at a periphery of the flex panels; and ii) a support structure field interposed between adjacent flex panels, the support structure field including a series of non-vertical fibs that define non-vertical hinges that are capable of facilitating radial deflection of the support structure field.

12. The container of claim 11, wherein the stiffness of the support structure field is greater about its vertical axis than about its horizontal axis, and wherein the support structure field is capable of inward deflection in response to the hot-filling process.

13. The container of claim 11, wherein the rim includes a pair of opposing lateral rims extending at least along sides of the flex panel, and a pair of opposing lateral recess walls extending between the central panel and the opposing lateral rims.

14. The container of claim 13, wherein the rim further includes a top and a bottom rim that merge into the opposing lateral rims and a top and a bottom recess wall extending between the central panel and the top and the bottom rim.

15. The container of claim 14, wherein the rims and recess walls are continuous around the perimeter of the central panel.

16. The container of claim 13, wherein each of the opposing lateral rims merge with at least some of the non-vertical ribs.

17. The container of claim 11, wherein at least some of the series of non-vertical ribs are concave as viewed from inside the container.

18. The container of claim 11, wherein a maximum magnitude of radially inward deflection of each of the central panels is approximately the same as a maximum magnitude of radially inward inflection of the support structure field in response to a container negative internal pressure.

19. The container of claim 11, comprising three flex panels and three support structure fields.

20. A hot-fillable container formed by blow molding, the container comprising:

a) a neck portion;

b) an enclosed bottom portion; and c) a body portion disposed between the neck portion and the bottom portion, the body portion including a flex portion comprising:

i) a plurality of spaced apart flex panels circumferentially disposed about the body portion, each of the plurality of flex panels including a central panel;

ii) a plurality of spaced apart ribbed regions circumferentially disposed about the body portion, each one of the plurality of ribbed regions interposed between adjacent flex panels and including a series of flex ribs;

wherein a maximum magnitude of radially inward deflection of each of the central panels is substantially equivalent to a maximum magnitude of radially inward deflection of each of the ribbed regions in response to a partial vacuum inside the container having a pressure differential of about 5 psi between an exterior and an interior of the container.

21. The container of claim 20, wherein each one of the ribs in the series of flex ribs is oriented in a non-absolute vertical orientation.

22. The container of claim 20, wherein each one of the ribs in the series of flex ribs is concave as viewed from inside the container.

23. The container of claim 20, wherein the flex ribs abut one another.

24. The container of claim 20, wherein a rim extends continuously around the perimeter of each of the central panels.

25. The container of claim 24, wherein opposing ends of the flex ribs that terminate at an adjacent rim.

* * * * *